US009157625B2

(12) United States Patent
Djajaatmadja et al.

(10) Patent No.: US 9,157,625 B2
(45) Date of Patent: Oct. 13, 2015

(54) LIGHTWEIGHT LIGHTING FIXTURE WITH IMPROVED HEAT MANAGEMENT CONFIGURATION

(71) Applicant: P.T. Padma Soode Indonesia, Bekasi (ID)

(72) Inventors: Sukandi Djajaatmadja, Walnut, CA (US); Chunghang Peng, Walnut, CA (US)

(73) Assignee: P.T. Padma Soode Indonesia, Bekasi (ID)

( * ) Notice: Subject to any disclaimer, the term of this patent is extended or adjusted under 35 U.S.C. 154(b) by 109 days.

(21) Appl. No.: 13/868,706

(22) Filed: Apr. 23, 2013

(65) Prior Publication Data

US 2014/0313735 A1 Oct. 23, 2014

(51) Int. Cl.

| | |
|---|---|
| ***F21V 7/00*** | (2006.01) |
| ***F21V 29/00*** | (2015.01) |
| ***F21K 99/00*** | (2010.01) |
| ***F21V 23/00*** | (2015.01) |
| ***F21V 23/02*** | (2006.01) |
| *F21Y 101/02* | (2006.01) |

(52) U.S. Cl.

CPC ..... *F21V 29/20* (2013.01); *F21K 9/1375* (2013.01); *F21V 7/00* (2013.01); *F21V 23/009* (2013.01); *F21V 23/026* (2013.01); *F21Y 2101/02* (2013.01)

(58) Field of Classification Search

CPC ..... F21K 9/00; F21K 9/10; F21K 9/13; F21K 9/1355; F21K 9/137; F21K 9/1375

USPC ..... 362/296.01, 296.02, 296.04, 249.02, 362/310

See application file for complete search history.

(56) References Cited

U.S. PATENT DOCUMENTS

| | | | | |
|---|---|---|---|---|
| 5,142,459 | A * | 8/1992 | Swarens et al. | 362/147 |
| 2010/0225220 | A1* | 9/2010 | Tanaka et al. | 313/46 |
| 2011/0068698 | A1* | 3/2011 | Swoboda et al. | 315/153 |

* cited by examiner

*Primary Examiner* — Sean Gramling

(74) *Attorney, Agent, or Firm* — Novak Druce Connolly Bove + Quigg LLP

(57) ABSTRACT

A lighting fixture configured for lightweight and improved thermal management. The lighting fixture includes a metallic sheet ballast housing configured to house a ballast, and a metallic sheet reflector coupled to the metallic sheet ballast housing via an interface member. The ballast is disposed on one side of the interface member, and a light emitting source is disposed on and attached to the opposite side of the interface member. Since the primary components of the lighting fixture are made out of sheet metal (e.g., with a thickness of approximately 0.5 to 1.0 millimeter), the lighting fixture may be configured to be significantly lightweight. Additionally, since the ballast and the light emitting source are respectively disposed on and attached to the interface member between the metallic sheet ballast housing and the metallic sheet reflector, heat generated by these devices may be easily dispersed via the ballast housing and the reflector.

4 Claims, 3 Drawing Sheets

LIGHTWEIGHT LIGHTING FIXTURE WITH IMPROVED HEAT MANAGEMENT CONFIGURATION

FIELD

This invention relates generally to lighting fixtures, and in particular, to a lightweight lighting fixture with improved heat management configuration.

BACKGROUND

Lighting fixtures often use light emitting sources that generate substantial heat. Such light sources include light emitting diode (LED)-based light sources, incandescent-based light sources, and others. The heat generated by these lighting emitting sources should be managed in order to maintain the light emitting sources operating within a safe operating temperature range. Operating these light emitting sources at high temperatures above a safe threshold may cause damage to and/or premature degradation of the light sources.

Generally, heat sinking structures are often designed into lighting fixtures in order to keep the light emitting sources within safe operating temperature ranges. Such heat sinking structures are often made out of a high thermal conducting material, such as metal, in order to facilitate the drawing of heat away from light emitting sources. To better remove heat from light emitting sources, the heat sinking structures are also designed to have a considerable amount of mass to better disperse the heat away from the light emitting sources. However, the large mass of heat sinks makes lighting fixtures undesirably heavy in weight.

Thus, there is a need for a lightweight lighting fixture with improved heat management configuration.

SUMMARY

An aspect of the invention relates to lighting fixture that is configured for lightweight and improved thermal management. The lighting fixture comprises a metallic sheet ballast housing configured to house a ballast, and a metallic sheet reflector coupled to the metallic sheet ballast housing via an interface member. The ballast is disposed on one side of the interface member, and a light emitting source is disposed on and attached to the opposite side of the interface member. Since the primary components of the lighting fixture are made out of sheet metal (e.g., with a thickness of approximately 0.5 to 1.0 millimeter), the lighting fixture may be configured to be significantly lightweight. Additionally, since the ballast and the light emitting source are respectively disposed on and attached to the interface member between the metallic sheet ballast housing and the metallic sheet reflector, heat generated by these devices may be easily dispersed via the ballast housing and the reflector.

Other aspects, advantages and novel features of the present invention will become apparent from the following detailed description of the invention when considered in conjunction with the accompanying drawings.

DETAILED DESCRIPTION OF THE EXEMPLARY EMBODIMENTS

Figure 1:
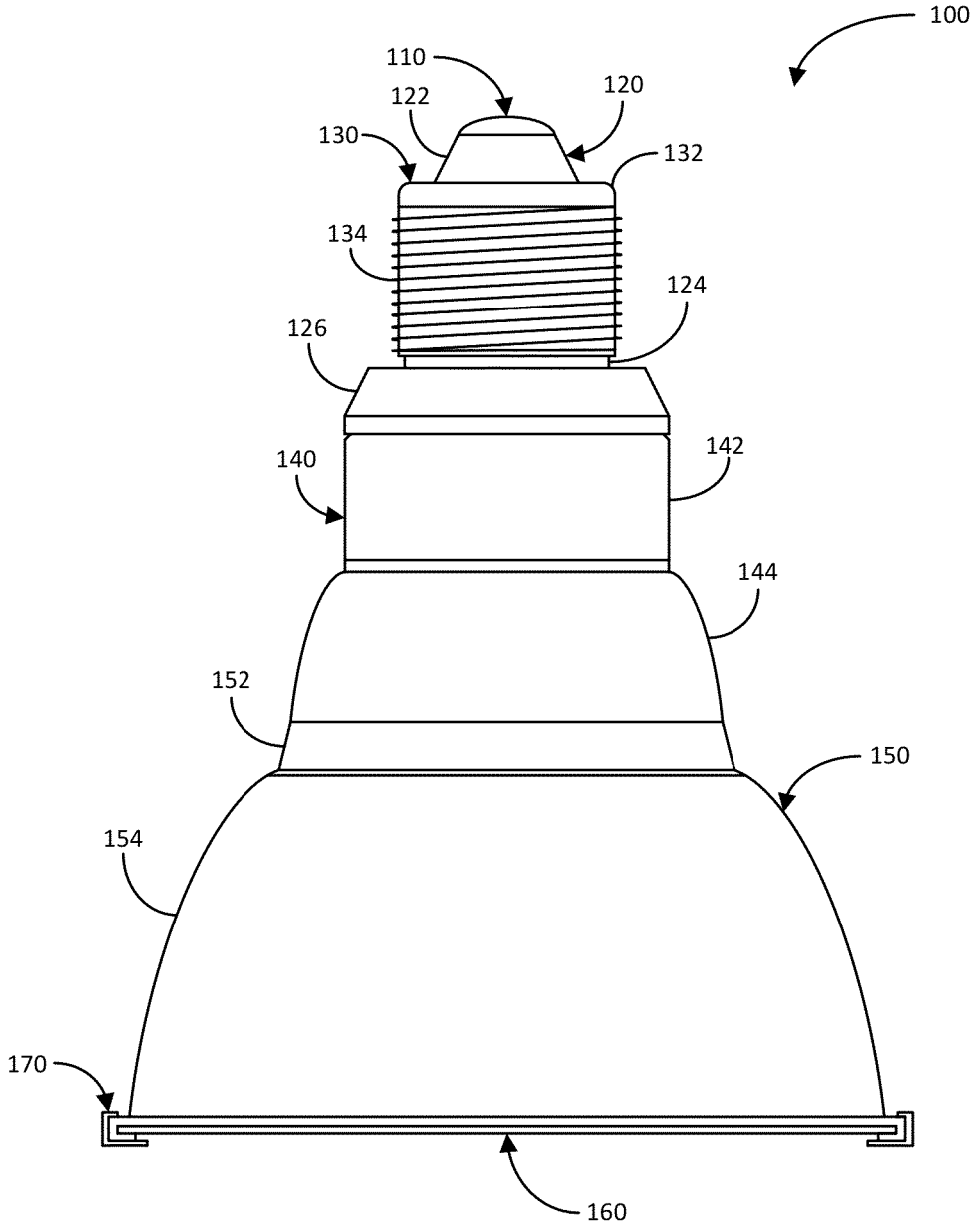
FIG. 1 illustrates a side view of an exemplary lighting fixture in accordance with an aspect of the disclosure.

FIG. 1 illustrates a side view of an exemplary lighting fixture 100 in accordance with an aspect of the disclosure. The lighting fixture 100 comprises a first electrical connector contact 110, an electrically-insulating connector structure 120, a second electrical connector contact 130, metallic sheet ballast housing 140, a metallic sheet reflector 150, a lens cover 160, and a trim 170.

The first and second electrical connector contacts 110 and 130, and the electrically-insulating connector structure 120 are configured to form a male connector for lamp socket. For instance, these components may be configured to form an E26 or E27 compliant male connector. In particular, the first electrical connector contact 110 is configured to mate with a corresponding contact of a lamp electrical socket (not shown). The first electrical connector contact 110 may have a dome-like shape. Similarly, the second electrical connector contact 130 is also configured to mate with another corresponding contact of the lamp electrical socket.

The electrically-insulating connector structure 120, which may be comprised of a plastic material, such as acrylonitrile butadiene styrene (ABS), or other type of electrical insulator, includes a top conical-shaped portion 122 configured to electrically isolate the first electrical connector contact 110 from the second electrical connector contact 130. The dome-shaped first electrical connector contact 110 is configured to be securely mounted to a top portion of the conical-shaped portion 122 of the electrically-insulating connector structure 120.

The second electrical connector contact 130 may be configured to have a hollow cylindrical-like shape, including threads 134 disposed around the external wall of the cylindrical-shaped contact 130, and a top portion 132 that curves radially inward to make contact with a lower portion of the conical-shaped portion 122 of the electrically-insulating connector structure 120. In other words, the top portion of the cylindrical-shape power line contact 130 includes an opening through which the conical-shaped portion 122 of the electrically-insulating connector structure 120 extends upwards.

The cylindrical-shaped contact 130 is coaxially mounted around a middle cylindrical portion 124 of the electrically-insulating connector structure 120. As discussed in more detail herein, the middle cylindrical portion 124 includes threads that mate with internal threads of the cylindrical-shaped contact 130. This allows the electrically-insulating connector structure 120 to be screwed into the cylindrical-shaped contact 130 from below.

The electrically-insulating connector structure 120 further comprises a lower cover portion 126 configured to coaxially cover a top portion of the metallic sheet ballast housing 140. As discussed in more detail herein, the electrically-insulating connector structure 120 comprises one or more threaded bores configured to receive corresponding one or more threaded screws for securely mating the metallic sheet ballast housing 140 to the electrically-insulating connector structure 120.

The metallic sheet ballast housing 140, which may be comprised of an aluminum sheet with a thickness of 0.5 to 1.0 millimeter (mm), includes a top narrower portion 142 and a bottom wider portion 144. As discussed in more detail herein, the metallic sheet ballast housing 140 includes a top wall through which one or more threaded screws extend into one or more threaded bores of the electrically-insulating connector structure 120 in order to securely mate the metallic sheet ballast housing 140 to the electrically-insulating connector structure 120. Also, as discussed in more detail herein, the metallic sheet ballast housing 140 is configured to house a driver or ballast for generating a drive signal for a light emitting source, such as a light emitting diode (LED) light source. As described further herein, separate wires electrically connect the first and second electrical connector contacts 110 and 130 to the ballast. The bottom portion 144 of the metallic sheet ballast housing 140 serves to coaxially cover for a top portion of the metallic sheet reflector 150, and includes bendable tabs for securely mating the metallic sheet ballast housing 140 to the metallic sheet reflector 150.

The metallic sheet reflector 150, which also may be comprised of an aluminum sheet with a thickness of 0.5 to 1.0 millimeter (mm), includes a small top portion 152 and a lower primary portion 154. The metallic sheet reflector 150 further comprises a top wall upon which the ballast rests. As discussed further herein, a light emitting source, such as an LED-based light emitting source, is mounted on the bottom of the top wall of the reflector 150. The top wall of the metallic sheet reflector 150 may include one or more openings for routing electrical connections between the ballast and the light emitting source. The inner surface of the primary portion 154 of the metallic sheet reflector 150 forms the light reflecting surface for the lighting fixture 100. A bottom end portion of the metallic sheet reflector 150 is bent to form a sideways U-channel. The sideways U-channel is configured to securely receive the perimeter of the lens cover 160. A trim 170 may be provided over and around the external perimeter of the sideways U-channel portion of the metallic sheet reflector 150 in order to provide a decorative trim for the lighting fixture 100.

Figure 2:
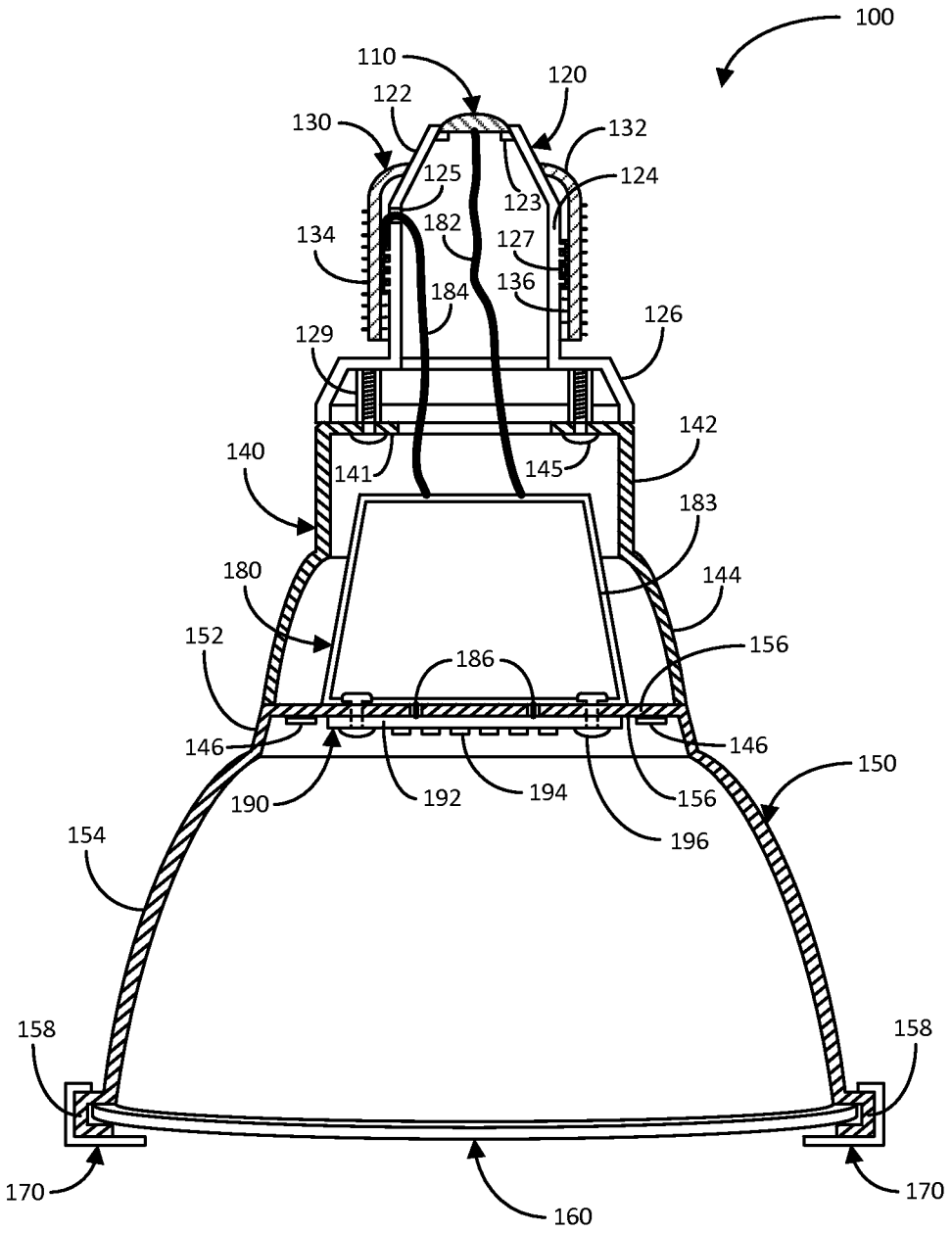
FIG. 2 illustrates a cross-sectional and internal side view of the exemplary lighting fixture in accordance with another aspect of the disclosure.

FIG. 2 illustrates a cross-sectional and internal side view of the exemplary lighting fixture 100 in accordance with another aspect of the disclosure. Beginning with the top of the light fixture 100, the first electrical connector contact 110 is securely coaxially lodged between a ring-shaped seat 123 and the rim of the conical-shaped portion 122 of the electrically-insulating connector structure 120. A wire 182 electrically connects the first electrical connector contact 110 to a ballast 180. This wire 182 is routed by way of internal chambers of the electrically-insulating connector structure 120 and the metallic sheet ballast housing 140.

A second wire 184 electrically connects the second electrical connector contact 130 to the ballast 180. A top end of the wire 184 makes compressed electrical contact to the second electrical connector contact 130 by being sandwiched between an inner surface of the second electrical connector contact 130 and an outer surface of the middle cylindrical portion 124 of the electrically-insulating connector structure 120. The wire 184 is routed to the ballast 180 by way of a hole 125 in the electrically-insulating connector structure 120, and via the internal chambers of the electrically-insulating connector structure 120 and the metallic sheet ballast housing 140.

As depicted, the external surface of the middle cylindrical portion 124 of the electrically-insulating connector structure 120 includes threads 127 for mating with corresponding threads 136 on the internal surface of the second electrical connector contact 130. This allows the electrically-insulating connector structure 120 to be screwed into the second electrical connector contact 130 from below. The lower cover portion 126 of the electrically-insulating connector structure 120 is configured to coaxially cover or fit over the top of the metallic sheet ballast housing 140. The lower cover portion 126 includes one or more threaded bores 129 for receiving corresponding one or more threaded screws 145 by way of one or more openings in a top wall 141 of the metallic sheet ballast housing 140. This securely mates the metallic sheet ballast housing 140 to the electrically-insulating connector structure 120.

The ballast 180 is disposed within the metallic sheet ballast housing 140, and is supported below by a top wall 156 of the metallic sheet reflector 150. The ballast 180 includes a foldable electrically insulating sheet 183 disposed along the outside wall of the ballast housing. The ballast 180 further comprises one or more electrical connections 186 for electrically connecting the ballast 180 to a light emitting source 190. The lower portion 144 of the metallic sheet ballast housing 140 is coaxially disposed over the upper portion 152 of the metallic sheet reflector 150. The metallic sheet ballast housing 140 includes one or more bendable tabs 146 configured to extend downward into the internal chamber of the metallic sheet reflector 150, and bend substantially 90 degrees so that the one or more tabs 146 are oriented substantially horizontal and flushed against a lower surface of the top wall 156 of the metallic sheet reflector 150. This securely mates the metallic sheet ballast housing 140 to the metallic sheet reflector 150.

The light emitting source 190 is mounted to the lower surface of the top wall 156 of the metallic sheet reflector 150 by use of one or more rivets 196. The light emitting source 190 comprises a printed circuit board (PCB) 192 including a plurality of LEDs 194 disposed thereon. The LEDs 194 are oriented to emit light downward and in the lateral direction, wherein the emitted light reflects off the reflective interior surface of the main portion 154 of the metallic sheet reflector 150, and exits the lighting fixture 100 through the lens cover 160. The electrical connections 186, which provide the drive signal for the LEDs 194, are routed through corresponding holes in the top wall 156 of the metallic sheet reflector 150 to the PCB 192 of the light emitting source 190.

The lower end of the main body 154 of the metallic sheet reflector 150 is bent to form a sideways U-channel 158. The sideways U-channel 158 is configured to receive the perimeter of the lens cover 160 for securely supporting the lens cover 160 in a substantially horizontal orientation. The decorative trim 170 is configured to be situated over and around the external perimeter of the sideways U-channel 158.

The configuration of the lighting fixture 100 results in a lightweight fixture due primarily to the sheet metal (e.g., aluminum sheet metal) used to form the metallic sheet ballast housing 140 and the metallic sheet reflector 150. The remaining parts are also lightweight in nature, such as the electrically-insulating connector structure 120, the first and second electrical connector contacts 110 and 130, lens cover 160, trim 170, and light emitting source 190. The element that contributes most to the weight of the lighting fixture 100 is the ballast 180. But since this is a single element, the lighting fixture 100 may be configured to be significantly light in weight for ease of handling and mounting, and to reduce stress on the fixture's supporting members.

The configuration of the lighting fixture 100 results in providing good thermal management of the heat generated by the ballast 180 and light emitting source 190. This is because the ballast 180 and the light emitting source 190 are attached to an interface member (e.g., the top wall 156) between the metallic sheet ballast housing 140 and the metallic sheet reflector 150. Both the metallic sheet ballast housing 140 and the metallic sheet reflector 150, made out of a heat conducting material, such as metal (e.g., aluminum sheet), facilitate the dispersement of heat generated by the ballast 180 and the light emitting source 190. The dispersement of heat away from the ballast 180 and light emitting source 190 allow these components to operate at lower temperatures to reduce the likelihood of damage or degradation due to thermal stress.

Although the interface member has been described as the top wall 156 of the metallic sheet reflector 150, it shall be understood that the interface member may be a bottom wall of the metallic sheet ballast housing 140. In other words, the metallic sheet ballast housing 140 may be configured with a bottom wall, and the metallic sheet reflector 150 may be configured without the top wall 156. In such a case, the ballast 180 would rest on a top surface of the bottom wall of the metallic sheet ballast housing 140 and the light emitting source 190 would be attached to a bottom surface of the bottom wall of the metallic sheet ballast housing 140.

Figure 3:
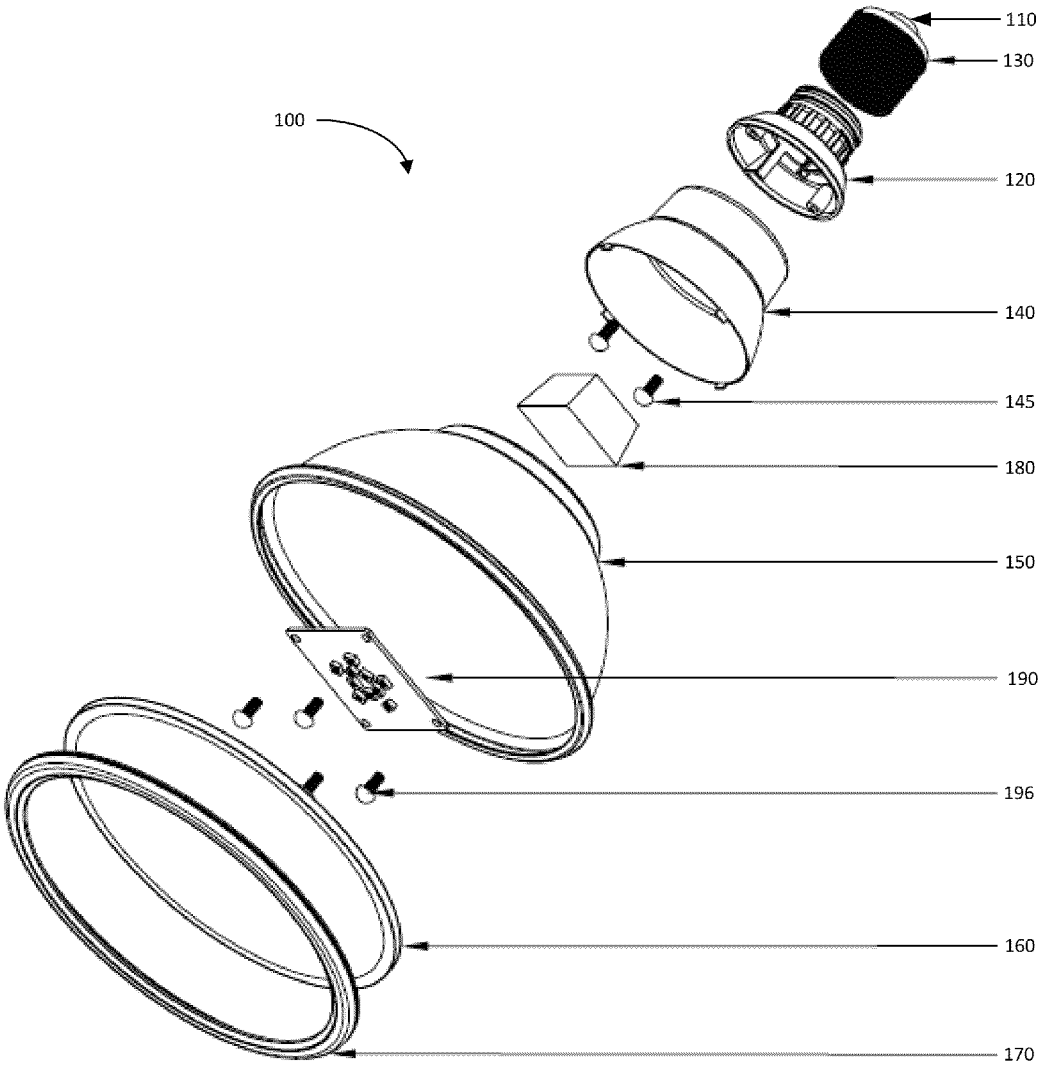
FIG. 3 illustrates a disassembled view of the exemplary lighting fixture in accordance with another aspect of the disclosure.

FIG. 3 illustrates a disassembled view of the exemplary lighting fixture 100 in accordance with another aspect of the disclosure. As depicted, from top to bottom, the lighting fixture 100 comprises the first electrical connector contact 110, the second electrical connector contact 130, the electrical-insulating connector structure 120, the metallic sheet ballast housing 140, the threaded screws 145, the ballast 180, the metallic sheet reflector 150, the light emitting source 190, the rivets 196, the lens cover 160, and the trim 170.

While the invention has been described in connection with various embodiments, it will be understood that the invention is capable of further modifications. This application is intended to cover any variations, uses or adaptation of the invention following, in general, the principles of the invention, and including such departures from the present disclosure as come within the known and customary practice within the art to which the invention pertains.

What is claimed is:

1. A lighting fixture comprising:

a metallic sheet reflector;

a metallic sheet ballast housing disposed over and attached to the metallic sheet reflector via an interface member;

a light emitting source securely attached to the interface member;

a ballast configured to generate a drive signal for the light emitting source, wherein the ballast is situated within the metallic sheet ballast housing;

a power line connector comprising:

a first electrical connector contact;

a second electrical connector contact, wherein the first and second electrical connector contacts are electrically coupled to the ballast; and an electrical-insulating connector structure upon which the first and second electrical connector contacts are supported in a manner that the electrical-insulating connector structure electrically isolates the first electrical connector contact from the second electrical connector contact, wherein the electrical-insulating connector structure is disposed over and attached to the metallic sheet ballast housing, wherein the electrical-insulating connector structure comprises:

a conical-shaped upper portion terminating in an opening, wherein the first electrical connector contact is attached coaxially to the conical-shaped upper portion in a manner to substantially cover up the opening;

a cylindrical-shaped middle portion including a first set of threads formed on an exterior surface of the cylindrical-shaped middle portion, wherein the second electrical connector contact comprises a cylindrical-shaped housing and includes a second set of threads on an interior surface of the cylindrical-shaped housing configured to mate with the first set of threads, and a lower cover portion comprising one or more threaded bores configured to receive threaded screws via one or more respective holes through a top horizontal wall of the metallic sheet ballast housing for securely mating the metallic sheet ballast housing to the electrical-insulating connector structure;

a first wire electrically connecting the first electrical connector contact to the ballast; and a second wire electrically connecting the second electrical connector contact to the ballast, wherein the first and second wires are situated inside of the electrical-insulating connector structure.

2. The lighting fixture of claim 1, wherein the power line connector is configured to form an E26 or an E27 compliant male connector.

3. The lighting fixture of claim 1, wherein an end of the second wire is sandwiched between the interior surface of the cylindrical-shaped housing of the second electrical connector contact and the exterior surface of the cylindrical-shaped middle portion of the electrical-insulating connector structure.

4. The lighting fixture of claim 3, wherein the cylindrical-shaped portion of the electrical-insulating connector structure comprises a hole through which the second wire extends from the second electrical connector contact to the ballast.

* * * * *